US011603607B2

(12) United States Patent
Muck et al.

(10) Patent No.: US 11,603,607 B2
(45) Date of Patent: Mar. 14, 2023

(54) FURNACE

(71) Applicant: EISENMANN SE, Böblingen (DE)

(72) Inventors: Matthias Muck, Adelebsen (DE); Dimitri Sabelfeld, Göttingen (DE)

(73) Assignee: EISENMANN SE, Böblingen (DE)

( * ) Notice: Subject to any disclaimer, the term of this patent is extended or adjusted under 35 U.S.C. 154(b) by 194 days.

(21) Appl. No.: 16/623,469

(22) PCT Filed: Jun. 13, 2018

(86) PCT No.: PCT/EP2018/065716
§ 371 (c)(1),
(2) Date: Dec. 17, 2019

(87) PCT Pub. No.: WO2018/234126
PCT Pub. Date: Dec. 27, 2018

(65) Prior Publication Data

US 2020/0181809 A1 Jun. 11, 2020

(30) Foreign Application Priority Data

Jun. 19, 2017 (DE) ..... 10 2017 113 342.9

(51) Int. Cl.
*D01F 9/32* (2006.01)
*D01F 9/22* (2006.01)
(Continued)

(52) U.S. Cl.
CPC ..... *D01F 9/32* (2013.01); *D01F 9/22* (2013.01); *F27D 17/001* (2013.01);
(Continued)

(58) Field of Classification Search
CPC ..... F27B 9/082; F27B 9/084; F27B 9/086; F27B 9/088; F27B 9/28; F27B 9/32;
(Continued)

(56) References Cited

U.S. PATENT DOCUMENTS 4,659,356 A * 4/1987 Lawhon ..... F27B 7/16 65/27
4,678,433 A * 7/1987 Ellison ..... F27B 9/28 432/59
(Continued)

FOREIGN PATENT DOCUMENTS

DE 38 78 606 8/1993
DE 692 23 449 4/1998
(Continued)

OTHER PUBLICATIONS

Office Action in related Chinese Application No. 2018800405451 dated Mar. 7, 2022, 9 pages.
(Continued)

*Primary Examiner* — Edelmira Bosques
*Assistant Examiner* — Michael James Giordano
(74) *Attorney, Agent, or Firm* — Schroeder Intellectual Property Law Group, LLC

(57) ABSTRACT

A furnace for thermal treatment, in particular for carbonization and/or graphitization, of material, in particular fibers, in particular fibers of oxidized polyacrylonitrile PAN. During the thermal treatment, a pyrolysis gas is released from the material. The furnace includes a housing, a process space, which is located in the interior of the housing and is delimited by a process space housing and through which the material can be fed, a heating system for heating a process space atmosphere prevailing in the process space, and an extraction system for suctioning process space atmosphere laden with pyrolysis gas from the process space. The extraction system has at least one suction device having a suction channel, which is delimited by a channel wall and which is connected to the process space by means of a suction opening. The suction opening is arranged in a region of the process space in which, during operation of the furnace a temperature prevails at which no or only moderate chemical
(Continued)

reactions occur between the pyrolysis gas and the process space housing and/or the channel wall.

11 Claims, 6 Drawing Sheets

(51) Int. Cl.

| | |
|---|---|
| ***F27D 17/00*** | (2006.01) |
| ***F27B 9/08*** | (2006.01) |
| ***F27B 9/28*** | (2006.01) |
| ***F27B 5/16*** | (2006.01) |

(52) U.S. Cl.
CPC ..... *D10B 2101/12* (2013.01); *F27B 9/082* (2013.01); *F27B 9/28* (2013.01); *F27B 2005/162* (2013.01); *F27D 17/008* (2013.01)

(58) Field of Classification Search
CPC ..... F27B 2005/162; F27D 17/001; F27D 17/008; F27F 9/22; D01F 9/22; D01F 9/32
See application file for complete search history.

(56) References Cited

U.S. PATENT DOCUMENTS

| | | | |
|---|---|---|---|
| 9,303,921 | B2 | 4/2016 | Berner |
| 2013/0171578 | A1 | 7/2013 | Berner |
| 2014/0161711 | A1 | 6/2014 | Kaji et al. |
| 2016/0002828 | A1 | 1/2016 | Kaji et al. |

FOREIGN PATENT DOCUMENTS

| | | | | | |
|---|---|---|---|---|---|
| DE | 10 2010 044 296 | | | 1/2012 | |
| EP | 2 738 292 | | | 6/2014 | |
| JP | H06-13950 | B2 | | 2/1994 | |
| JP | S60-13950 | A | | 1/1995 | |
| JP | 2000-088464 | | | 3/2000 | |
| JP | 2010 133 059 | A | | 6/2010 | |
| JP | 5778363 | B1 | | 9/2015 | |
| JP | 2016 133 277 | A | | 7/2016 | |
| JP | 2016133277 | A | * | 7/2016 | ..... F27B 9/082 |
| WO | WO-8401368 | A1 | * | 4/1984 | ..... D01F 9/32 |

OTHER PUBLICATIONS

English Translation of Office Action in related Korean Pat. App. No. 10-2019-7037603, 8 pages.

* cited by examiner

FURNACE

RELATED APPLICATIONS

This application is a national phase of International Patent Application No. PCT/EP2018/065716 filed Jun. 13, 2018, which claims priority to German Patent Application No. 10 2017 113 342.9 filed Jun. 19, 2017—the contents of both of which are incorporated herein by reference.

FIELD OF THE INVENTION

The invention relates to a furnace for thermal treatment, in particular for carbonization and/or graphitization, of material, in particular of fibers, in particular of fibers of oxidized polyacrylonitrile PAN, wherein a pyrolysis gas is released from the material during the thermal treatment, with a) a housing;
b) a process space, which is located in the inner space of the housing and which is bounded by a process space housing and through which the material can be guided;
c) a heating system, by means of which a process space atmosphere which prevails in the process space can be heated;
d) an extraction system, by means of which process space atmosphere loaded with pyrolysis gas can be exhausted from the process space.

BACKGROUND OF THE INVENTION

Such furnaces are used in particular for the manufacturing of carbon fibers, which are formed from fibers of polyacrylnitrile fibers in a three- or four-stage process. Polyacrylonitrile is mostly abbreviated as PAN in the following. Felts and fleeces can also be treated in such furnaces. Materials other than PAN are, for example, viscose and lignin.

In a first manufacturing stage, polyacrylonitrile is oxidized in an oxidation furnace at temperatures between approximately 200° C. and 400° C. in the presence of oxygen to oxidized PAN fibers.

These oxidized PAN fibers are then subjected in a second stage to a thermal treatment in an oxygen-free inert gas atmosphere in a furnace at approximately 400° C. to 1000° C. in order to increase the proportion of carbon in the fibers by carbonisation, wherein the proportion of carbon is approximately 62% by weight in the case of the oxidized PAN fibers. Usually, nitrogen $N_2$ or argon Ar are used as inert gas.

In a third manufacturing stage, the heat treatment is carried out in a furnace of the type mentioned above, known as a high-temperature furnace, between 800° C. and 1800° C. in a nitrogen atmosphere, wherein a carbonization occurs in which the PAN fibers pyrolyze until they have a carbon proportion of approximately 92% to 95% by weight.

If necessary, the carbon fibers obtained after the third production stage are subjected in a fourth manufacturing stage to a further thermal treatment in an oxygen-free inert gas atmosphere at temperatures between 1800° C. and 3000° C. in a furnace of the type mentioned above; at these temperatures a graphitisation of the carbon fibers occurs, which afterwards have a carbon proportion of more than 99% by weight and are referred to as so-called graphite fibers. Usually, argon Ar is used as the inert gas for graphitization.

When oxidized PAN fibers are thermally treated in an oxygen-free inert gas atmosphere at temperatures above 700° C., a pyrolysis gas is released from the PAN fibers which contains, among others, hydrogen cyanide HCN, nitrogen $N_2$, ammonia $NH_3$, carbon dioxide $CO_2$, carbon monoxide CO and methane $CH_4$. Since the contained hydrogen cyanide HCN in particular is highly toxic, the process space atmosphere loaded with the pyrolysis gas is exhausted from the process space by means of the extraction system and fed to a downstream processing treatment. In most cases, the process gas atmosphere exhausted and loaded with pyrolysis gas is burnt, but there are also installations in which the hydrogen cyanide is chemically converted in order to obtain the hydrogen cyanide as a material resource.

In known high-temperature furnaces, the process space is lined with a muffle made of a material which chemically reacts and is attacked by the pyrolysis gas released from the PAN fibers. In furnaces known from the market, the muffle consists of graphite, which is attacked by the pyrolysis gas at temperatures above approximately 1000° C. The exhaust gas ducts or conduits of the extraction system, through which the process space atmosphere loaded with pyrolysis gas is guided away from the process space, are also usually lined with the muffle material; the exhaust gas ducts or conduits consequently also react at corresponding temperatures with the extracted process atmosphere loaded with pyrolysis gas and are attacked. Over time, the pyrolysis gas causes damage to the muffle and the exhaust ducts or pipes.

There are approaches to cover the muffle in the process space with so-called sacrificial graphite plates, which are then replaced at regular intervals. However, the problems with the exhaust gas ducts remain.

SUMMARY OF THE INVENTION

It is the object of the invention to provide a furnace of the type mentioned at the beginning, in which the strain on the process space and on ducts or conduits, through which process atmosphere loaded with pyrolysis gas is guided, is reduced.

This object is solved in that e) the extraction system comprises at least one exhaust device with an exhaust duct which is bounded by a duct wall and which is connected to the process space via an exhaust opening;
f) the exhaust opening is arranged in a region of the process space in which, during operation of the furnace, a temperature prevails at which no or only moderate chemical reactions occur between the pyrolysis gas and the process space housing and/or the duct wall.

The invention is based on the recognition that the strain on the parts and components that come into contact with the pyrolysis gas and react with the pyrolysis gas in an undesirable manner can be considerably reduced if it is ensured that the pyrolysis gas is exhausted at an early stage of the thermal treatment at a temperature at which there is no reaction of the components involved. For this purpose, the exhaust point, which is defined by the position of the exhaust opening of the exhaust duct, is specifically placed in a region of the process space in which corresponding low temperatures prevail.

Preferably, during operation of the furnace, a temperature of less than 1000° C., preferably less than 900° C., and particularly preferably less than 800° C. prevails in this region.

It is advantageous if the region is located next to or near an inlet opening of the process space housing for the material to be treated. In this way it is possible to take advantage of the fact that the temperature in the process space is usually gradually increased from the inlet to the outlet, at least in the region after the inlet a temperature can prevail at which no undesirable reactions occur. At the beginning of the process space the largest portion of pyrolysis gas is usually already released from the fibers, which is effectively removed in this way without being able to cause major damage. The amount of pyrolysis gas released at higher temperatures in subsequent regions of the process space is in contrast justifiably negligible.

An assembly which can be technically realized with relatively little effort results when the exhaust duct extends through the inlet opening into the process space.

In different operating modes of one and the same furnace, it can occur that the region, in which the desired, relatively low temperatures prevail, is developed at the different locations in the process space. It is therefore advantageous if the exhaust duct is configured such that position of the exhaust opening can be changed.

Preferably, the exhaust duct for this purpose comprises a plurality of duct sections which are detachably connected to each other such that the length of the exhaust duct can be adjusted by the number of provided duct sections. The exhaust duct can thus be extended or shortened in a modular manner.

It is advantageous if the exhaust duct is connected at an end, which is remote from the exhaust opening, to a collecting duct which for its part is connected to a thermal afterburning device. If a plurality of exhaust ducts are present, they can be merged in a common collecting duct or each connected to its own collecting duct.

It is advantageous if a passage housing of the exhaust device, in which the collecting duct extends at least regionwise, is arranged in front of an inlet passage of the housing of the furnace. Such a housing can easily be arranged between the housing of the furnace on the one hand and an inlet lock, which is present in most cases, on the other hand and thus be integrated into the overall system.

The extraction system can be used particularly well if the process space housing is configured as a muffle, in particular as a muffle made of graphite.

The exhaust system also functions particularly effectively if the exhaust duct and/or the collecting duct are made of graphite or are lined with graphite.

BRIEF DESCRIPTION OF THE DRAWINGS

Embodiments of the invention are described in more detail in the following based on the drawings.

DETAILED DESCRIPTION OF THE INVENTION

Figure 1:
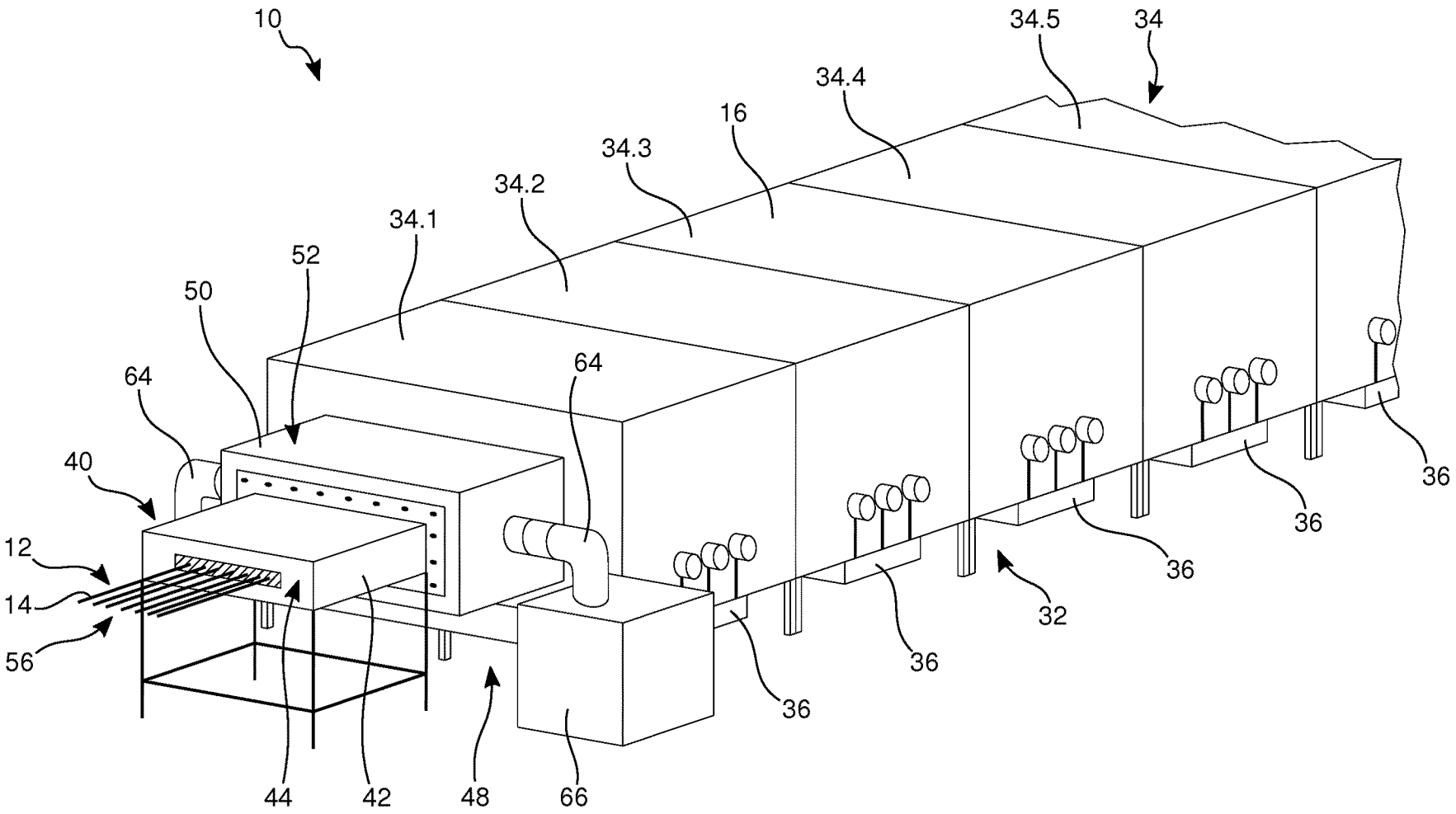
FIG. 1 shows a perspective view of a furnace for thermal treatment of carbon fibers with an extraction system for process gas atmosphere, the extraction system comprising an exhaust device.
Figure 2:
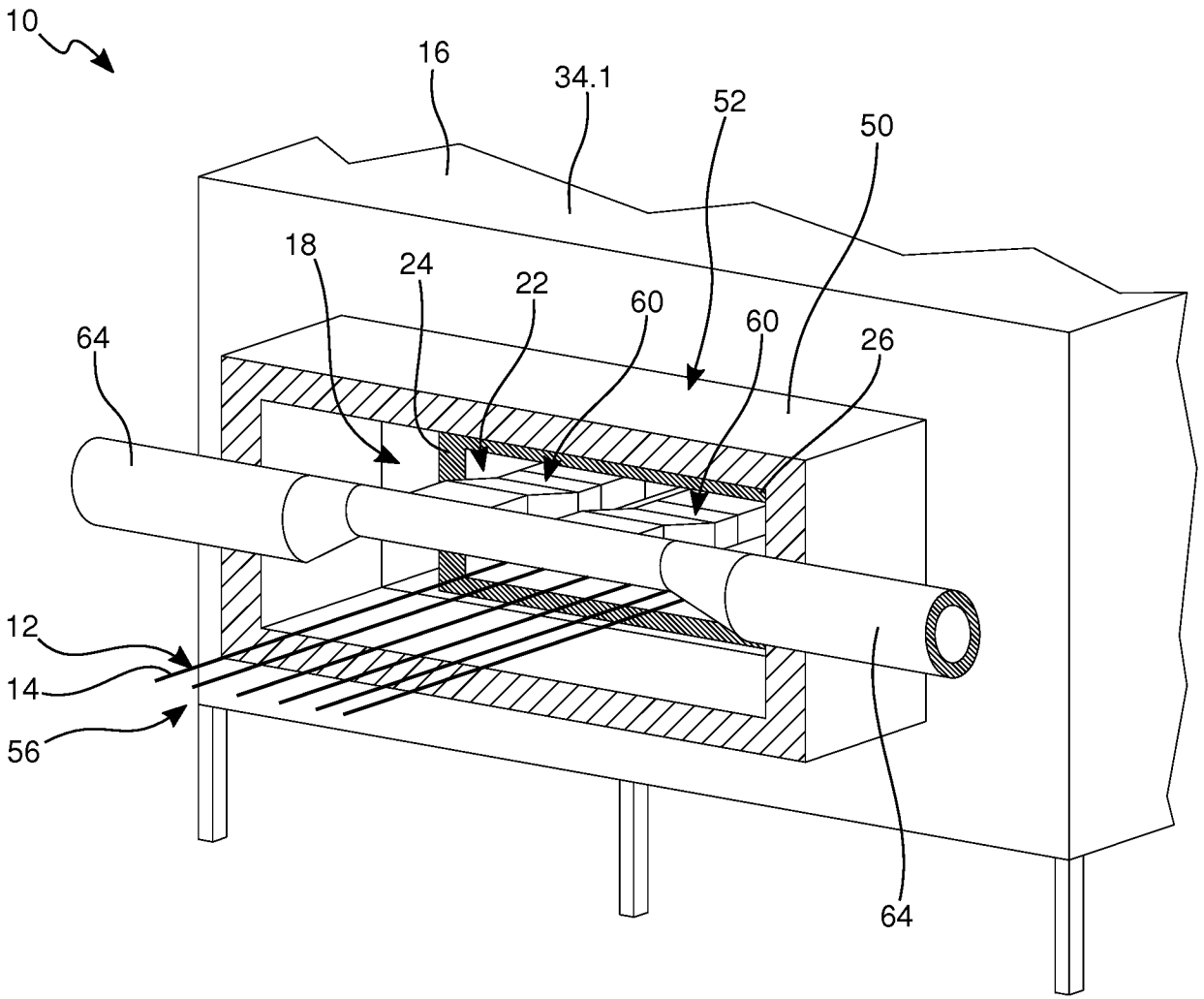
FIG. 2 shows a perspective view of the exhaust device with a sectioned housing so that exhaust ducts protruding through an inlet into the process space are visible.

In the figures, a furnace 10 for thermal treatment of material is shown, which in the embodiments shown in FIGS. 1 to 9 are fibers 12 and, for instance, fibers 14 of oxidized polyacrylonitrile, which are hereinafter referred to as oxPAN fibers 14.

The furnace 10 comprises a thermally insulated furnace housing 16, which bounds an inner space 18. The furnace housing 16 has a fiber inlet passage 20 at one end face and a fiber outlet passage at an opposite end face, which cannot be seen due to the views shown in the figures.

In the inner space 18 of the furnace housing 16 a process space 22 is located, which for its part is bounded by a process space housing 24 in the form of a muffle 26. In the embodiment at hand, the muffle 26 is made of graphite. The process space housing 24, i.e. the muffle 26, has a fiber inlet opening 28 at an end face and a fiber outlet opening 28 at an opposite end face, which also cannot be seen in the figures. During operation of the furnace 10, a process space atmosphere 30 prevails in the process space 22.

The furnace 10 comprises a heating system 32 with which the process space atmosphere 30 is heated. In the process space 22 between the fiber inlet opening 22 and the fiber outlet opening of the muffle 26 successive heating zones 34 are formed, of which five heating zones 34.1, 34.2, 34.3, 34.4 and 34.5 can be seen in FIG. 1. The temperature increases from heating zone to heating zone such that a temperature gradient of approximately 800° C. to about 1800° C. is present in the process space 22. Each heating zone 34 is associated with a separate heating device 36, which heats up the muffle 26 in the corresponding heating zone 34 accordingly, as is known in and of itself. For this purpose, the muffle 26 in each heating zone 34 is, for example, encompassed by a heating cage not specifically shown, which is arranged in the space between the muffle 26 and the furnace housing 16. This space defines a heating space 38 encompassing the muffle 26.

The heating space 38 is bounded at the end face by an insulation 39 which is only schematically indicated by a line. In the heating space 38 an inert gas atmosphere prevails, for which the heating space 38 is fed with an inert gas by means of an inert gas device not specifically shown; nitrogen $N_2$ is usually used as inert gas for the heating space 38.

On the inlet side, the furnace 10 comprises an inlet lock 40 with a separate lock housing 42 and an outlet lock with a separate lock housing, which again cannot be seen to the views shown. An inert gas 46 is supplied via the inlet lock 40 to the inner space 18 of the furnace housing 16, and thus to the heating space 38 and the process space 22, with the aid of an inert gas device 44, so that the thermal treatment of the ox-PAN fibers 14 occurs in an inert gas atmosphere. As mentioned at the beginning, nitrogen $N_2$ or argon Ar are used as inert gas in practice. The process space atmosphere 30 is therefore a mixture of the inert gas and of the pyrolysis gas released during the treatment of the oxPAN fibers 14.

The furnace 10 also comprises an extraction system referenced to overall by 48, by means of which the process space atmosphere 30 can be exhausted from the process space 22.

In the embodiment at hand, a passage housing 50 of an exhaust device 52 of the extraction system 48 is arranged between the inlet lock 40 and the furnace housing 16, which bounds a flow space 54. The flow space 54 is connected in a gas-tight fashion on one side with the inlet lock 40 and in a gas-tight fashion on the other side with the furnace housing 16, so that the inert gas 46 can flow from the inlet lock 40 through the flow space 54 into the process space 22.

The oxPAN fibers 14 are fed as a fiber carpet 56 through the inlet lock 40, through the flow space 54 and further through the fiber inlet passage 20 of the furnace housing 16 into its inner space 18 and there through the fiber inlet opening 28 of the process space housing 24 into the process space 22 with the aid of a conveyor system, which is not specifically shown and is known of and in itself. The fiber carpet 56 passes through the process space 22 and the heating zones 34 established there and is then discharged from the furnace 10 through the fiber outlet opening of the process space housing 24 and through the fiber outlet passage of the furnace housing 16 and finally through the outlet lock connected thereto.

In order to exhaust the process space atmosphere 30 loaded with pyrolysis gas, the exhaust device comprises at least one exhaust duct 60 bounded by a duct wall 58 and connected to the process space 22 via an exhaust opening 62. In the embodiments shown, there are two such exhaust ducts 60, which have the same reference marks; in principle, a single exhaust duct 60 can be sufficient. Like the muffle 26, the exhaust ducts 60 are made of graphite or lined with graphite.

In the embodiment at hand, supplementary exhaust openings 63 are provided as a variant on the side facing the fiber carpet 56 in the duct wall 58; in most cases, however, these exhaust openings 63 can be dispensed with.

The exhaust ducts 60 comprise the exhaust opening 62 at a free end and are connected at their end, which is remote from the exhaust opening 62, in the flow space 54 of the exhaust device 52 with a collecting duct 64, which extends through the passage housing 50 to both sides outward and there leads to a thermal afterburning device 66 in each case. The collecting duct 64 is also made of graphite or is lined with graphite.

For the sake of clarity, further parts, components and exhaust gas ducts or conduits of the extraction system 48, through which the resulting exhaust gases from the thermal afterburning system 66 are passed, are not specifically shown.

The exhaust ducts 60 extend from the flow space 54 of the exhaust device 52 through the fiber inlet passage 20 of the furnace housing 16 and through the fiber inlet opening 28 of the muffle 26 into the process space 22, wherein the exhaust ducts 60 are arranged above the fiber carpet 56.

In this way, the exhaust openings 62 of the exhaust ducts 60 are located in the process space 22, wherein they are positioned in a region 68 of the process space 22 which defines an inert exhaust region and in which a temperature prevails at which no or at least only a moderate chemical reaction occurs between the pyrolysis gas in the process space atmosphere 30 and the muffle 26 as well as the exhaust ducts 60. A chemical reaction of the pyrolysis gas with the collecting duct 64 as well as the other conduits of the extraction system 48 not shown is then also prevented or reduced. With regard to graphite as the material of the muffle 26 and the exhaust ducts 60, the temperature in the region 68 must not exceed approximately 1000° C., since the undesirable chemical reactions between graphite and the pyrolysis gas occur at this temperature.

In practice, care is taken to ensure that the temperature in the region 68 is less than 900° C., better less than 800° C. The region 68 is in most cases located directly next to the fiber inlet opening 28 of the process space 22.

Depending on the operating mode of the furnace 10, the position of the region 68 defined by the temperature prevailing there within the process space 22 can however also change or the length of this area can change, depending on the set temperature profile in the process space 22. For this reason, the exhaust ducts 60 are configured such that the position of the exhaust opening 62 can be changed.

In the embodiment at hand, the exhaust ducts 60 are for this purpose assembled from duct sections 72 in an end section 70 comprising the exhaust opening 62, wherein the duct sections 72 are detachably connected to one another so that the length of the exhaust ducts 60 can be adjusted by the number of duct sections 72 provided.

Figure 3:
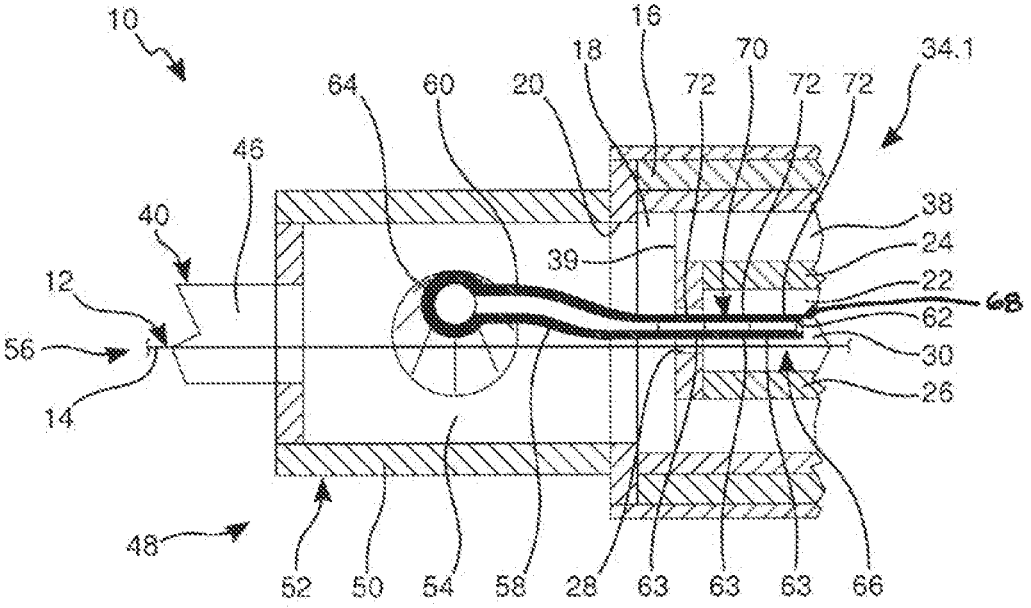
FIG. 3 shows a partial section of the furnace in which one of the exhaust ducts of the exhaust device, which is connected to the process space via an exhaust opening, is visible.
Figure 4:
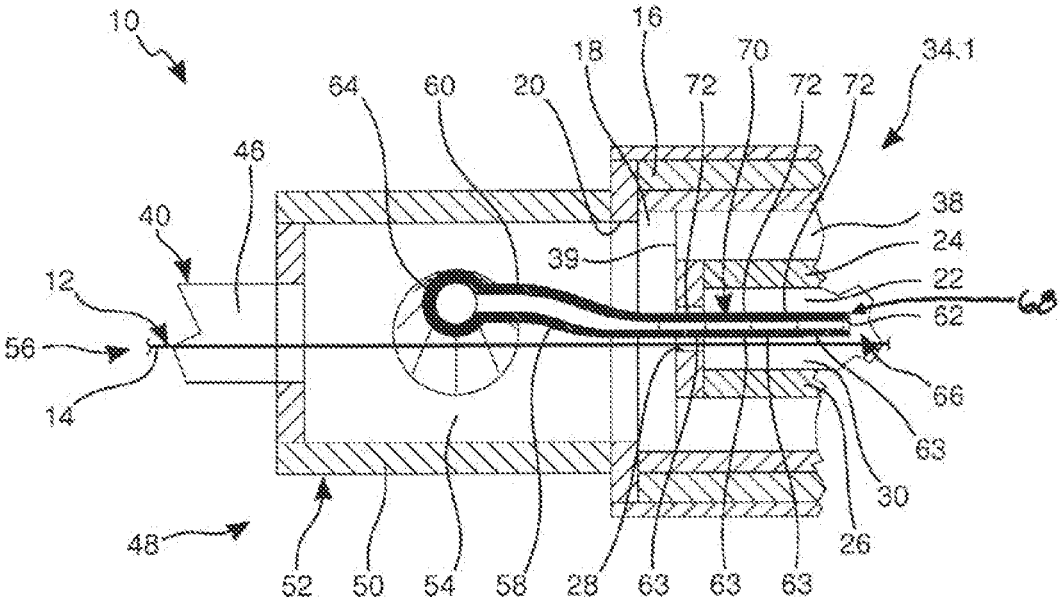
FIG. 4 shows a partial section of the furnace, wherein the position of the exhaust opening of the exhaust duct is changed with respect to the position in FIG. 3.
Figure 5:
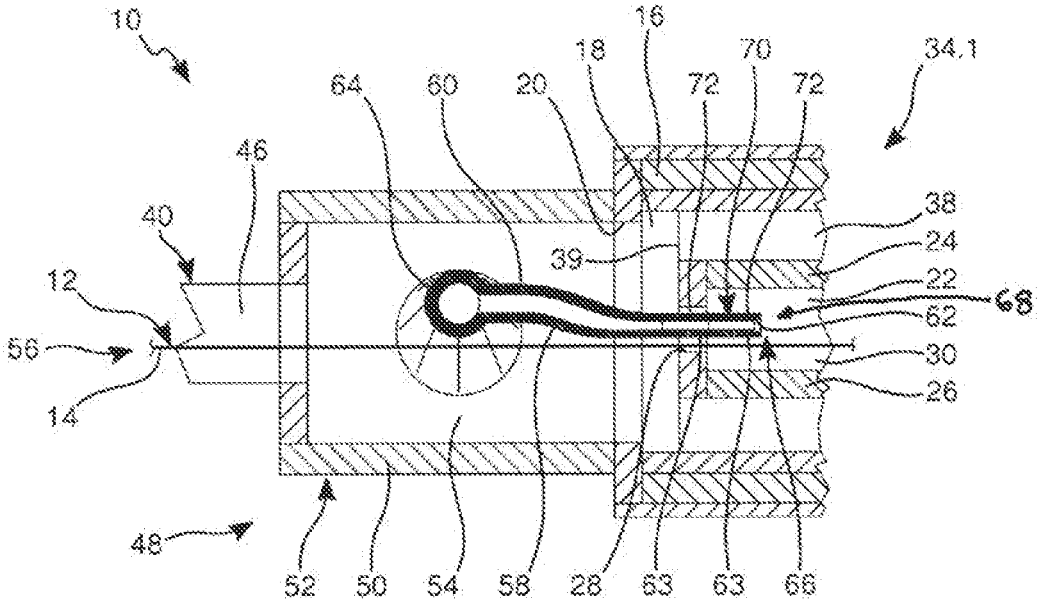
FIG. 5 shows a partial section of the furnace, wherein the position of the exhaust opening of the exhaust duct is changed once again with respect to the positions in FIGS. 3 and 4.

FIG. 3 shows an end section 70 of three duct sections 72. FIG. 4 shows an exhaust duct 60, the end section 70 of which is formed from four duct sections 72, so that the exhaust opening 62 is arranged farther away from the fiber inlet opening 28 and farther in the interior of the process space 22 compared to FIG. 3. FIG. 5 shows an exhaust duct 60, the end section 70 of which is formed from only two duct sections 72, so that the exhaust opening 62 is arranged closer to the fiber inlet opening 28 and thus less far inside the process space 22 compared to FIGS. 3 and 4.

The respective terminal duct section of these duct sections 72 therefore defines the exhaust opening 62 of the exhaust duct 60. If the supplementary exhaust openings 63 are provided, these are accordingly present at the duct sections 72.

In the case of modifications not specifically shown, the exhaust ducts 60 can also be configured so that they can be changed in shape, so that the position of the exhaust opening 62 can be shifted by varying the course of the exhaust ducts 60 and, for example, by bringing them into an arc shape.

Figure 6:
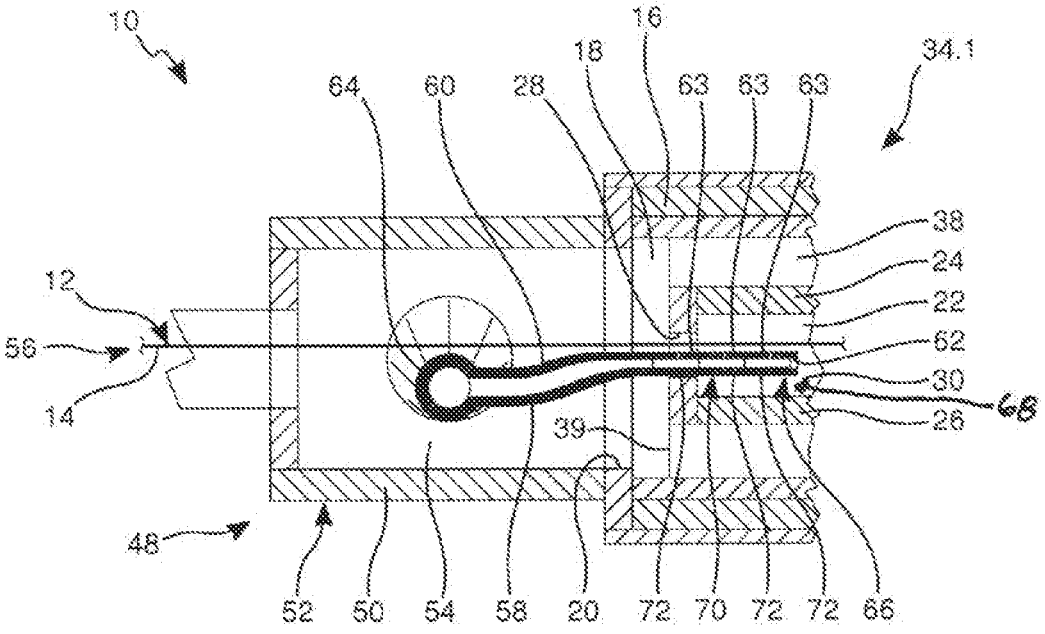
FIG. 6 shows a partial section of the furnace, wherein an exhaust duct is shown in a modified arrangement.

FIG. 6 shows a modified exhaust device 52 in which the exhaust ducts 60 are arranged below the fiber carpet 56. Apart from that, the above applies accordingly.

Figure 7:
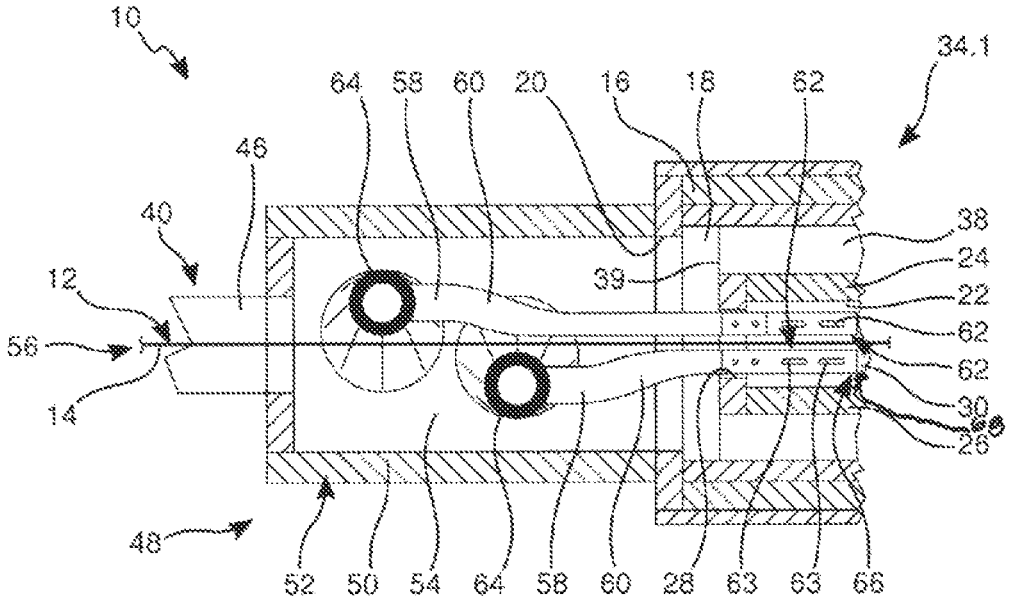
FIG. 7 shows a partial section of the furnace, wherein two exhaust ducts are visible.

FIG. 7 shows a further modified exhaust device 52. On the one hand, one exhaust duct 52 runs above and one exhaust duct 52 below the fiber carpet 56. On the other hand, the exhaust ducts 52 do not comprise an exhaust opening at their free end, but rather several lateral exhaust openings 62, which are to be understood as exhaust openings 62 provided laterally on the flanks and/or on the side facing the fiber carpet 56 in the duct wall 58.

An exhaust opening is provided at the free end of the exhaust ducts 60 if the exhaust ducts 60 can be changed in their length by corresponding duct sections 70, as in the previous embodiments. The duct sections 70 can then comprise corresponding lateral exhaust openings 62 in the duct wall 58.

Figure 8:
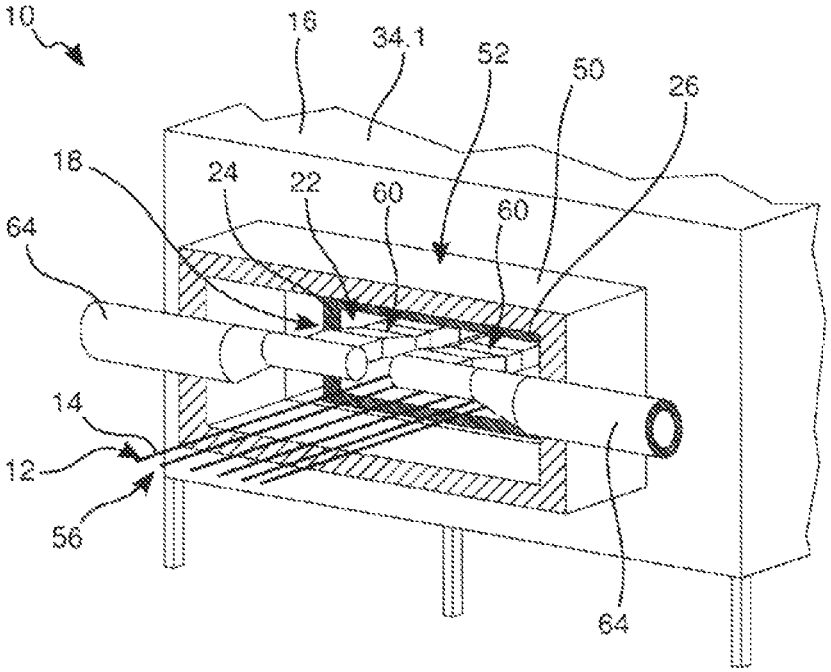
FIG. 8 shows a perspective view of the exhaust device with a sectioned housing of a variant of the exhaust device.

FIG. 8 illustrates a variant in which each of the two exhaust ducts 60 is connected to its own collecting duct 64, each of which leads to its own thermal afterburning device, which are not shown separately again in FIG. 8.

Figure 9:
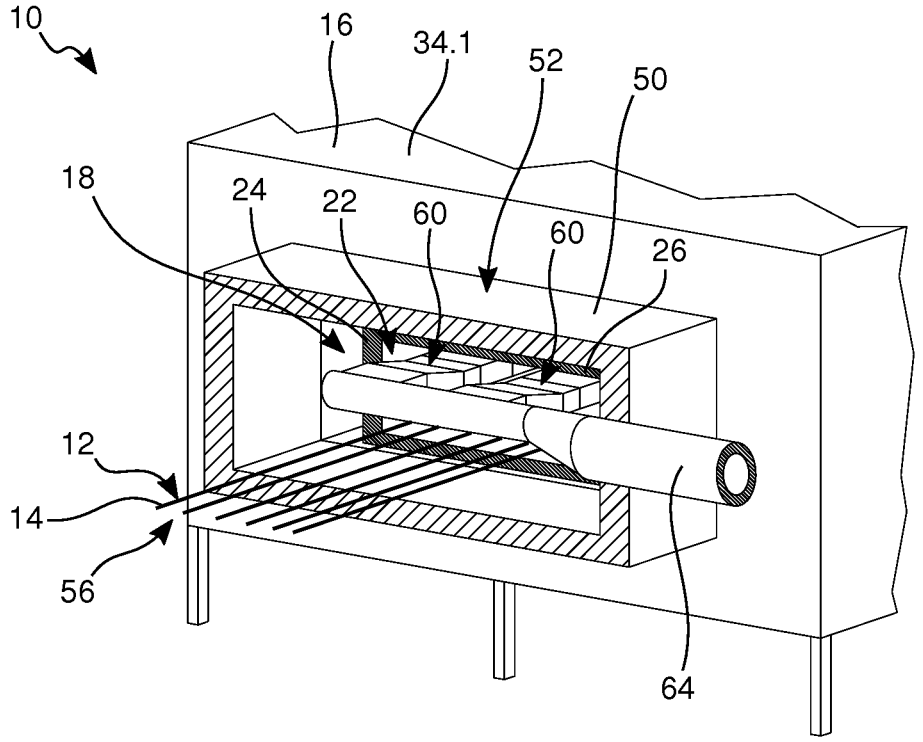
FIG. 9 shows a perspective view of the exhaust device with a sectioned housing of a further variant of the exhaust device.

FIG. 9 illustrates a variant in which again both present exhaust ducts 60 are connected to a common collecting duct 64; however, this extends only on one side through the passage housing 50 of the exhaust device 52.

Figure 10:
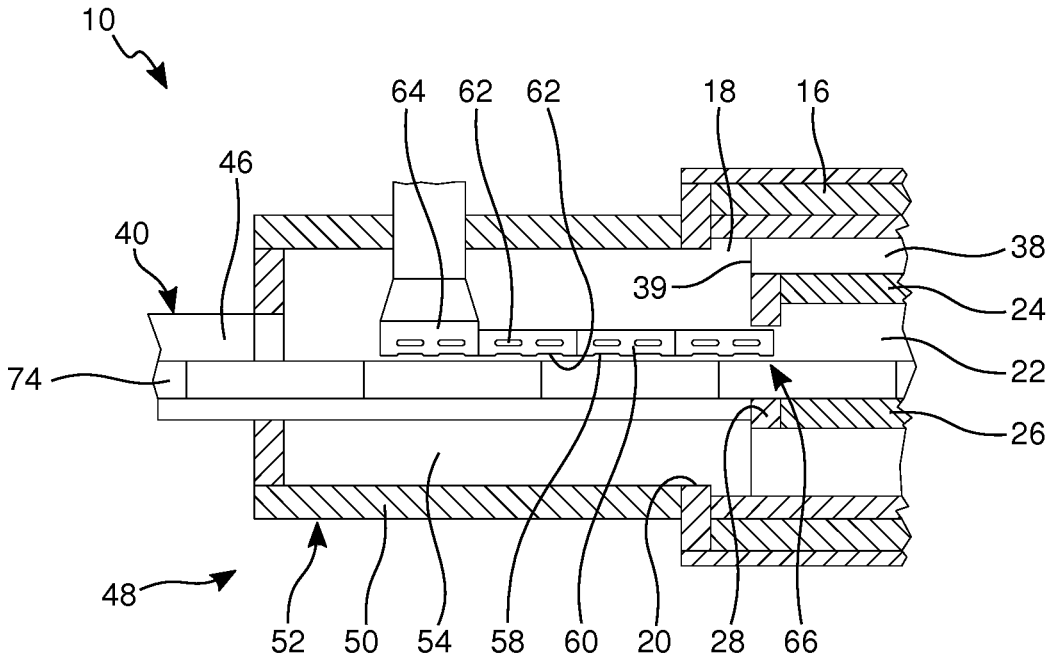
FIG. 10 shows a partial section of a modified furnace.

FIG. 10 shows a modification of a furnace 10, which is not configured for the thermal treatment of fibers 12, but rather for the thermal treatment of plate-shaped materials 74, during the thermal treatment of which a pyrolysis gas is released. Such materials include, for example, hard felts. Endless materials such as nonwovens and soft felts as roll goods are to be classified as plate-shaped materials.

This plate-shaped material 74 is conveyed through the process space 22 via a conveying device not specifically shown, which can be, for example, a pusher system. In the variant shown in FIG. 10, the exhaust ducts 60, of which only one is visible due to the section, run above the material 74 and again comprise lateral exhaust openings on the flanks and on the side of the duct wall 58 facing the material 74. In this modification, the collecting duct 64 also does not extend to the side but rather upwards through the passage housing 50 of the exhaust device 52.

In the case of modifications of the embodiments described above not specifically shown, the exhaust ducts 60 can also be configured with protective plates made of silicon carbide SiC. If temperatures should nevertheless occur at the exhaust opening 62 at which a chemical reaction of the pyrolysis gas with the muffle 26 or the exhaust ducts 60 can occur, the SiC is chemically reduced, wherein the muffle 26 remains protected.

What is claimed is:

1. A furnace for thermal treatment of material, wherein a pyrolysis gas is released from the material during the thermal treatment, comprising:

a) a housing;

b) a process space, which is located in an inner space of the housing and which is bounded by a process space housing and through which material can be guided, the process space being located next to or near an inlet opening of the process space housing, the material to be treated passing through and being fed into the process space through the inlet opening;

c) a process space atmosphere which is heated and prevails in the process space;

d) an extraction system, by means of which process space atmosphere loaded with pyrolysis gas can be exhausted from the process space, wherein e) the extraction system comprises at least one exhaust device with an exhaust duct which is bounded by a duct wall and which is connected to the process space via an exhaust opening, the exhaust duct extending through the inlet opening and entering the process space adjacent the material to be treated, wherein the material enters adjacent and external to the exhaust duct;

f) the exhaust opening is arranged in a region of the process space in which, during operation of the furnace, a temperature prevails at which no or only moderate chemical reactions occur between the pyrolysis gas and the process space housing and/or the duct wall.

2. The furnace according to claim 1, wherein during operation of the furnace, a temperature of less than 1000° C. prevails in the region.

3. The furnace according to claim 1, wherein the exhaust duct is configured such that the position of the exhaust opening can be changed.

4. The furnace according to claim 3, wherein the exhaust duct comprises a plurality of duct sections which are detachably connected to each other such that the length of the exhaust duct can be adjusted by the number of provided duct sections.

5. The furnace according to claim 1, wherein the exhaust duct is connected at an end, which is remote from the exhaust opening, to a collecting duct which for its part is connected to a thermal afterburning device.

6. The furnace according to claim 5, wherein a passage housing of the at least one exhaust device, in which the collecting duct extends at least region-wise, is arranged in front of an inlet passage of the housing.

7. The furnace according to claim 1, wherein the process space housing is configured as a muffle.

8. The furnace according to claim 1, wherein the exhaust duct and/or the collecting duct are made of graphite or are lined with graphite.

9. The furnace according to claim 2, wherein during operation of the furnace, a temperature of less than 900° C. prevails in the region.

10. The furnace according to claim 1, wherein during operation of the furnace, a temperature of less than 800° C. prevails in the region.

11. The furnace according to claim 7, wherein the muffle is made of graphite.

* * * * *